US005716135A

United States Patent [19]

Campbell

[11] Patent Number: 5,716,135

[45] Date of Patent: Feb. 10, 1998

[54] SHOPPING BAG HAVING RESTRAINING TABS AND AN ASSOCIATED METHOD

[76] Inventor: Wilson S. Campbell, 27 Cherokee Trace, Lake Toxaway, N.C. 28747

[21] Appl. No.: 592,201

[22] Filed: Jan. 26, 1996

[51] Int. Cl.[6] ..... B65D 33/18

[52] U.S. Cl. ..... 383/8; 383/62; 383/84

[58] Field of Search ..... 383/8, 62, 77, 383/84, 86, 14

[56] References Cited

U.S. PATENT DOCUMENTS

| | | | |
|---|---|---|---|
| 2,394,335 | 2/1946 | Shapiro . | |
| 3,420,433 | 1/1969 | Bostwick | 383/62 X |
| 3,735,918 | 5/1973 | Tunderman | 383/84 X |
| 3,806,024 | 4/1974 | Marchesani | 383/62 |
| 3,977,596 | 8/1976 | Gamble . | |
| 3,990,627 | 11/1976 | Olson | 383/62 |
| 4,790,670 | 12/1988 | Barbaro . | |
| 5,149,202 | 9/1992 | Dickert | 383/40 X |
| 5,282,686 | 2/1994 | Haber . | |

FOREIGN PATENT DOCUMENTS

| | | | |
|---|---|---|---|
| 1917318 | 10/1970 | Germany | 383/84 |
| 0254557 | 10/1989 | Japan | 383/84 |

*Primary Examiner*—Jes F. Pascua

*Attorney, Agent, or Firm*—David V. Radack; Eckert Seamans Cherin & Mellott, LLC

[57] ABSTRACT

A shopping bag including a first panel, a second panel and pair of opposed side panels which together form a shopping item container area adapted to hold at least one shopping item. The shopping item container area includes an opening through which the shopping item is placed into the shopping item container area. The shopping bag further includes at least one restraining tab extending from the first panel, the tab including a free end portion having disposed thereon an adhesive. The free end portion can be secured to the second panel in order to at least partially close the opening so as to restrain the shopping items from escaping from the shopping item container area. An associated method is also disclosed.

3 Claims, 5 Drawing Sheets

SHOPPING BAG HAVING RESTRAINING TABS AND AN ASSOCIATED METHOD

BACKGROUND OF THE INVENTION

This invention relates to a shopping bag having restraining tabs and an associated method.

Shopping bags are well known articles that are used by shoppers to transport groceries and other shopping items. These shopping bags include panels which form a container area for holding the shopping items. The container area includes an opening through which the items are placed. The items, however, can also fall out through this opening when the shopping bag is tilted or laid horizontally or when the shopping bag is transported in a vehicle. This is especially a problem with plastic grocery bags, because typically, these bags do not have a flat horizontal floor panel (such as paper shopping bags) that serves to keep the shopping bag upright.

What is needed therefore, is a simple, easy to use and easy to manufacture shopping bag that is constructed and arranged to restrain items from escaping from the shopping item container area.

SUMMARY OF THE INVENTION

The shopping bag of the invention has met or exceeded the above-mentioned needs as well as others. The shopping bag comprises a first panel, a second panel and pair of opposed side panels which together form a shopping item container area adapted to hold at least one shopping item. The shopping item container area includes an opening through which the shopping item is placed into the shopping item container area. The shopping bag further includes at least one restraining tab extending from the first panel, the tab including a free end portion having disposed thereon an adhesive. The free end portion can be secured to the second panel in order to at least partially close the opening so as to restrain the shopping items from escaping from the shopping item container area.

An associated method of packing shopping items for subsequent transportation thereof is also provided. The method comprises providing a shopping bag as described above and placing at least one shopping item into the shopping item container area. After this, the tab of the shopping bag is secured to the second panel to at least partially close the opening of the shopping bag. In this way, shopping items are restrained from escaping from the shopping item container area.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
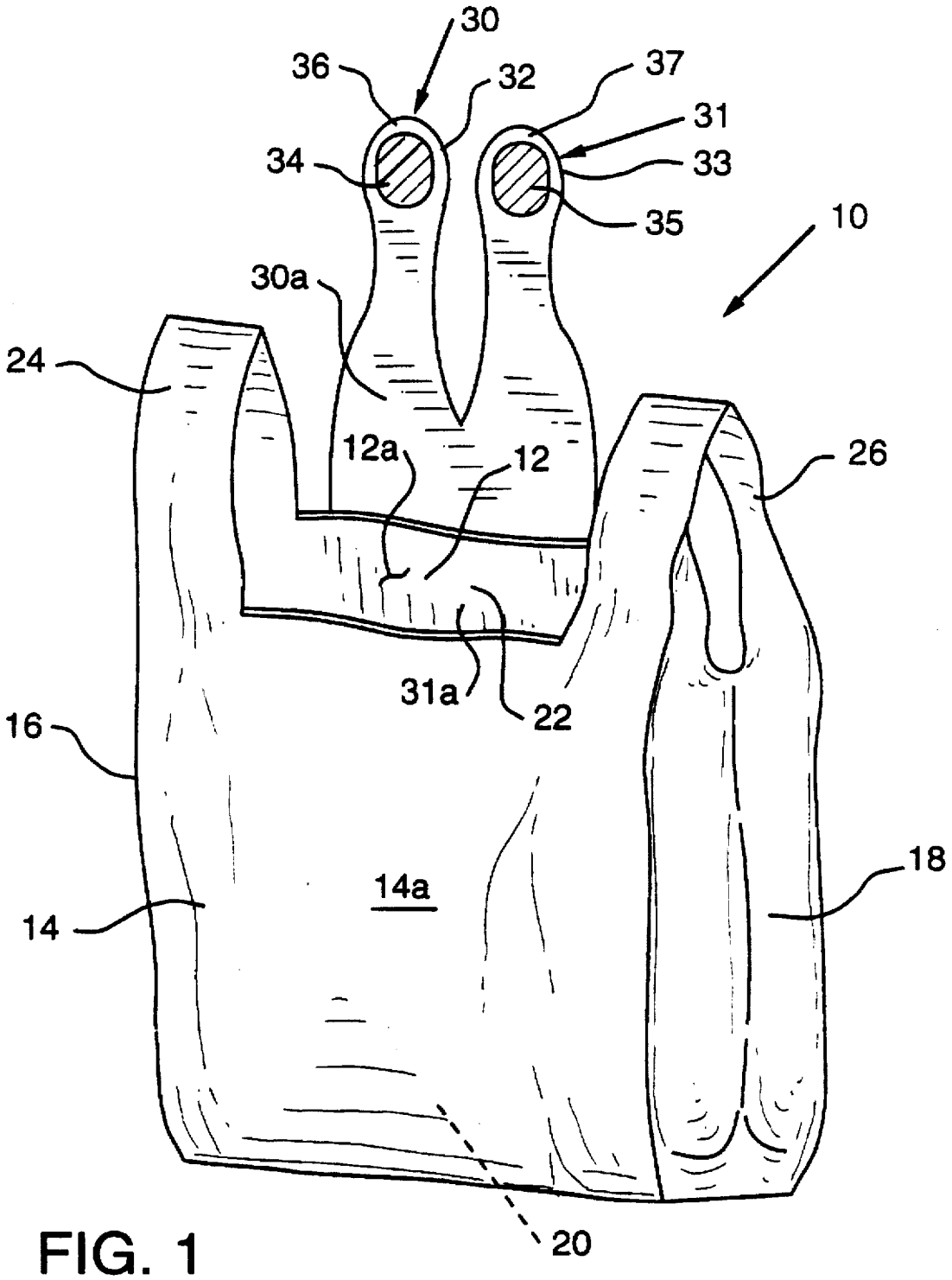
FIG. 1 is a perspective view of the shopping bag of the invention with no shopping items placed therein and the restraining tabs in an extended position.
Figure 2:
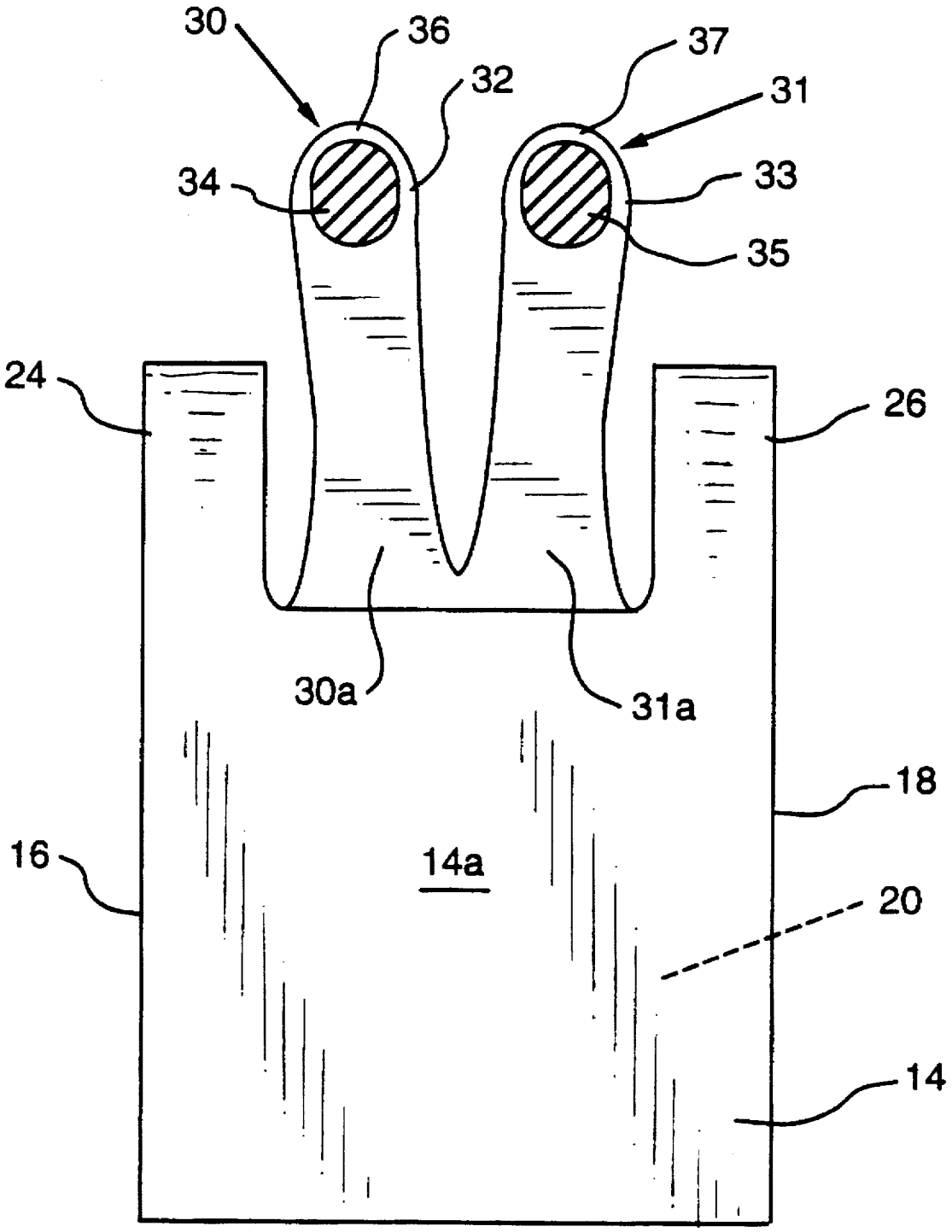
FIG. 2 is a front elevational view of the shopping bag of FIG. 1 showing the tabs of the invention extending from the first panel.
Figure 3:
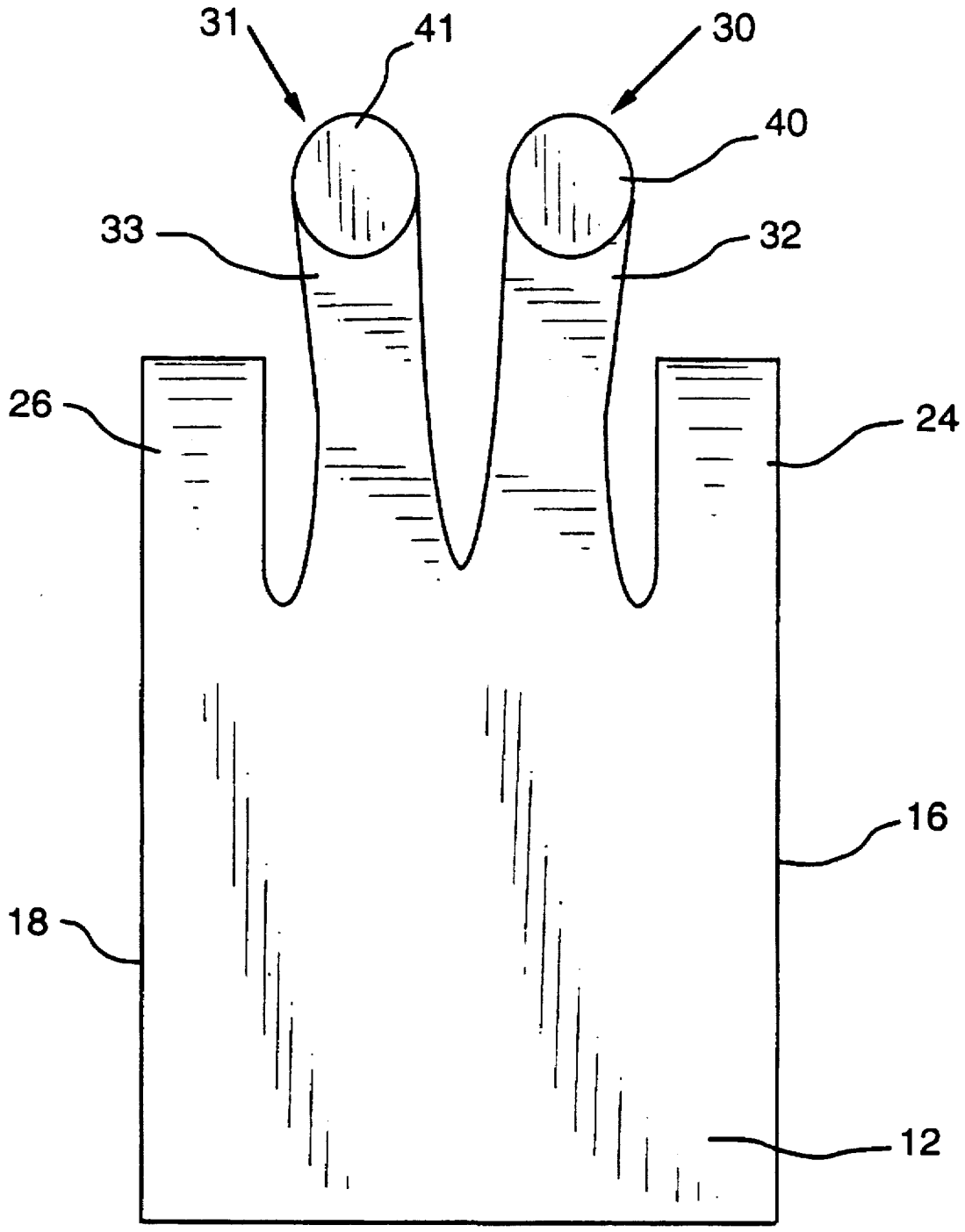
FIG. 3 is a back elevational view of the shopping bag of FIG. 1 showing the tabs of the invention extending from the first panel.

Referring now to FIGS. 1–3, the shopping bag 10 of the invention will be described in more detail. The shopping bag 10 shown in FIGS. 1–3 is used for transporting groceries from a supermarket to a home, for example, and is made of plastic. It will be appreciated, however, that the shopping bag of the invention is not limited to this particular purpose but can be used for other shopping items, such as dry goods from a department store. Similarly, although the described embodiment is made of plastic, other flexible materials, such as paper, can be used to construct the shopping bag 10.

The shopping bag 10 consists of a first panel 12, a second panel 14 and a pair of opposed side panels 16 and 18. The panels 12, 14, 16 and 18 define a shopping item container area 20 which holds shopping items (not shown in FIG. 1). Access to the shopping item container area 20 is gained through top opening 22. The shopping bag 10 also preferably includes a pair of handles 24 and 26. These handles 24 and 26 facilitate carrying the shopping bag 10, as is known. The handles 24 and 26 extend from spaced apart portions of the panels 16 and 18. It will be appreciated, however, that the handles 24 and 26 are a preferred option and do not form an essential part of the invention.

In accordance with the invention, at least one tab, and as shown in FIGS. 1–5, a pair of restraining tabs 30 and 31 extend from the first panel 12. The tabs 30 and 31 are in a generally parallel spaced apart relationship. The tabs 30, 31 can be separately secured to the first panel 12, however, it is preferred that they be integral to the first panel 12. This is because the shopping bag 10 is preferably made all at once by known die cutting manufacturing processes. The tabs 30 and 31 each include a free end portion 32 and 33 having disposed thereon an adhesive 34 and 35.

As can be seen in FIGS. 1 and 2, the adhesive 34, 35, which can be any known type of adhesive that can be applied to the particular material used for the shopping bag. For example, a low peel, pressure sensitive, hot-melt adhesive can be used. As can further be seen by observing FIG. 1, the free end portions 32, 33 include end sections 36, 37 which do not contain adhesive. This will facilitate manipulation of the tabs 30, 31 as will be explained below.

Referring to FIG. 3, it will be noted that the free end portions 32, 33 include a colored portion 40, 41 to clearly indicate that the adhesive 34, 35 is disposed thereunder. The colored portion 40, 41 is optional, but preferred, and should be of a color that contrasts to the color of the tabs 30, 31 in order to easily identify to the user the portion of the tab 30, 31 that should be manipulated.

Figure 4:
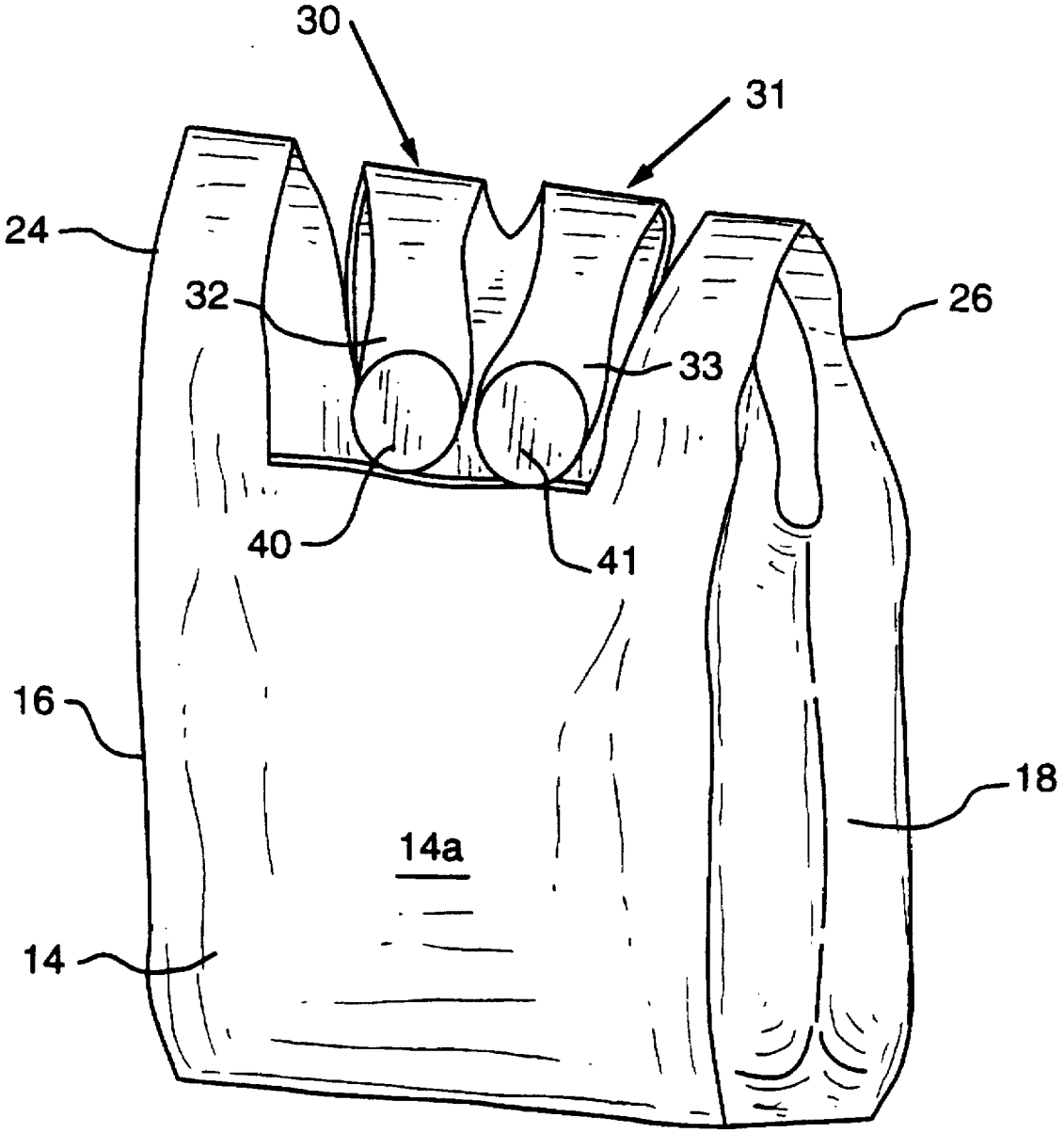
FIG. 4 is a perspective view of the shopping bag of FIG. 1 only showing the shopping bag in its storage position, i.e., before shopping items are placed therein.
Figure 5:
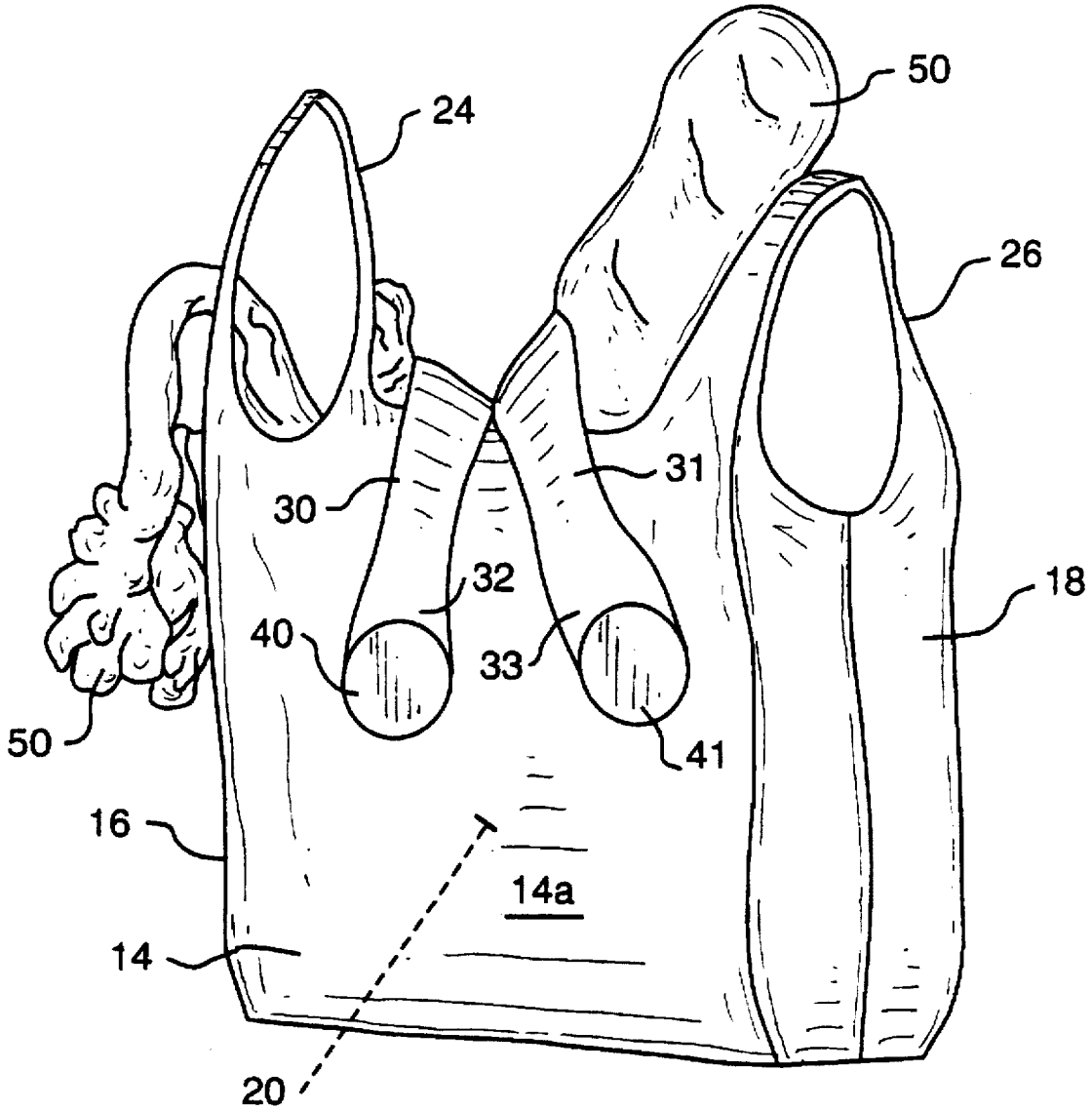
FIG. 5 is a perspective view of a loaded shopping bag showing the tabs at least partially closing the opening of the shopping bag.

Referring now to FIGS. 4 and 5, the use of the tabs 30, 31 will be explained. Particularly, FIG. 4 shows how the shopping bag 10 is stored before use. Preferably, the tabs 30 and 31 are folded so that the free end portion 32 and 33 are secured to the base 30*a*, 31*a* of the tabs 30, 31 (best seen in FIGS. 1 and 2). It will be appreciated that the tabs 30, 31 are twice the length of the distance from the top of the handle to the opening 22 of the shopping bag 10. In any event, the tabs 30, 31 are constructed so as to not obstruct the top opening 22 while shopping items are placed therein and also positioned so that after the shopping bag 10 is filled, the tabs 30, 31 can still be reached.

After the shopping bag 10 has been filled with shopping items 50 (see FIG. 5), the user or grocery store employee merely removes the free end portions 32, 33 of the tabs 30, 31 from the base 30*a*, 31*a* of each tab 30, 31 by gripping the non-adhesive end sections 36, 37 and pulling them up and away from the respective base 30*a*, 31*a* of the tabs 30, 31. Due to the general properties of adhesives, this removal force (which is normal to the plane of the tabs 30, 31) easily accomplishes removal of the tabs 30, 31 from the base 30*a*, 31*a*. However, when the free end portions 32, 33 are in place on the surface 14*a* of the second panel 14 as is shown in FIG. 5, it takes a large shear-type force to pull the adhesive away from the panel. Thus, the tabs 30, 31 are designed to be easily removed when it is desired to load the shopping items therein as explained above (and conversely, to be easily removed from a position where the tabs close the opening when it is desired to remove the shopping items from the shopping bag) but, on the other hand, the tabs 30, 31 are difficult to tear from the surface 14*a* of the second panel 14 once the shopping items are loaded therein and being transported by a shear force caused by shifting of the shopping items during transport.

The tabs 30, 31 are extended over and at least partially close the opening 22 of the shopping item container area 20 in order to restrain the shopping items 50 therein from escaping from the shopping item container area 20 through the opening 22. It will be appreciated that the tabs 30, 31 are especially needed for plastic shopping bags, such as shopping bag 10, because these plastic bags do not stand upright, such as paper grocery bags, when being transported and thus have a tendency to shift and thus allow the shopping items 50 contained therein to escape from the bag while being transported in a car or other vehicle. The shopping bag 10 of the invention solves this problem of prior art shopping bags.

It will be appreciated that the design of the tabs allows for adjustment of the size of opening 22 of the shopping item container area 20. That is, the free end portions 32, 33 can be placed at any desired point on the outside surface 14*a* of the second panel 14. This facilitates providing a tightly closed shopping bag 10 to the consumer once the shopping items 50 are placed therein. This in turn will resist undesired escape of the shopping items 50 from the shopping item container area 20.

An associated method of packing at least one shopping item for transport thereof is also provided. The method involves providing a shopping bag 10 as described above, including at least one restraining tab and placing at least one shopping item into the shopping item container area. The method then involves securing the tab to the second panel in order to at least partially close the opening so as to restrain the shopping items from escaping from the shopping item container.

It will be appreciated that a shopping bag and an associated method has been provided which resists undesired escape of shopping items from the shopping bag. The shopping bag is easy to manufacture and easy to use and provides a needed improvement for transporting shopping items, such as groceries, in a plastic shopping bag.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A plastic, non-rigid shopping bag comprising:

a plastic, non-rigid first panel;

a plastic, non-rigid second panel;

a pair of opposed plastic, non-rigid side panels, said first, second and pair of side panels cooperating to form a shopping item container area adapted to hold at least one shopping item, said shopping item container area including an opening through which said shopping item is placed into said shopping item container area;

at least one plastic, non-rigid restraining tab extending from first panel, said tab including a free end portion having disposed thereon an adhesive with said free end portion adapted to being secured to said second panel in order to at least partially close said opening so as to restrain said shopping items from escaping from said shopping item container area;

at least one handle extending from one of said panels for carrying said shopping bag;

said free end portion includes an end section that does not have disposed thereon an adhesive and which is adapted to be gripped by a user in order to secure said tab to said second panel; and said restraining tab is generally a first color with said free end portion having a second color which contrasts to said first color in order to more clearly indicate said non-adhesive section that is to be gripped by said user.

2. A method of packing at least one shopping item for subsequent transport thereof, said method comprises:

providing a plastic, non-rigid shopping bag including (i) a plastic, non-rigid first panel; (ii) a plastic, non-rigid second panel; (iii) a pair of opposed plastic, non-rigid side panels, said first, second and pair of side panels cooperating to form a shopping item container area including an opening; (iv) at least one plastic, non-rigid restraining tab extending from said first panel, said tab including a free end portion having disposed thereon an adhesive; and (v) at least one handle extending from one of said panels for carrying said shopping bag;

placing at least one shopping item into said shopping item container area;

securing said tab to said second panel by means of said adhesive in order to at least partially close said opening so as to restrain said shopping item from escaping from said shopping item container area;

providing said first panel having an outside surface and an inside surface;

before using said shopping bag to transport said shopping item, securing said free end portion to said inside surface of said first panel so that after said shopping item is placed in said shopping item container area and it is desired to at least partially close said opening, said free end portion is unsecured from said inside surface of said front panel and then secured to said second panel; and providing said second panel having an outside surface and in inside surface; and when it is desired to use said shopping bag to transport said shopping item, unsecuring said free end portion from said inside surface of said first panel and subsequently securing said free end portion to said outside surface of said second panel in order to at least partially close said opening.

3. The method of claim 2, including providing said free end portion with an end section that does not have disposed thereon an adhesive; and using said end section to manipulate said tab during securing and unsecuring of said tab to said second panel.

* * * * *